US008651970B2

(12) United States Patent
Chen

(10) Patent No.: US 8,651,970 B2
(45) Date of Patent: Feb. 18, 2014

(54) PLAYGROUND SLIDE

(76) Inventor: Samuel Chen, Shanghai (CN)

( * ) Notice: Subject to any disclaimer, the term of this patent is extended or adjusted under 35 U.S.C. 154(b) by 79 days.

(21) Appl. No.: 13/523,565

(22) Filed: Jun. 14, 2012

(65) Prior Publication Data

US 2013/0337924 A1 Dec. 19, 2013

(51) Int. Cl.
*A63G 21/00* (2006.01)
*A63G 21/18* (2006.01)

(52) U.S. Cl.
USPC ..... 472/116; 472/88; 472/117

(58) Field of Classification Search
USPC ..... 472/88–90, 116, 117, 128; 104/69, 70
See application file for complete search history.

(56) References Cited

U.S. PATENT DOCUMENTS

| | | | | |
|---|---|---|---|---|
| 3,539,181 | A * | 11/1970 | Larsen | 472/117 |
| 4,299,171 | A * | 11/1981 | Larson | 104/70 |
| 6,342,015 | B1 * | 1/2002 | Robertson et al. | 472/116 |
| 7,662,045 | B2 * | 2/2010 | Sammann et al. | 472/116 |
| 2008/0081707 | A1 * | 4/2008 | Banta | 472/116 |

* cited by examiner

*Primary Examiner* — Kien Nguyen
(74) *Attorney, Agent, or Firm* — Clement Cheng

(57) ABSTRACT

A playground slide has a pair of side rails, including a left side rail and a right side rail, and the pair of side rails is parallel to each other. A slide sheet has a slide sheet top surface, and the slide sheet top surface has a slide sheet left edge. The slide sheet top surface has a slide sheet right edge, and the slight sheet left edge is mounted to a bottom surface of the left side rail. The slide sheet right edge is mounted to a bottom surface of the right side rail. A pair of support rails, namely a left support rail and a right support rail, supports the slight sheet. The pair of support rails is parallel to each other, and the pair of support rails is mounted to a bottom surface of the slide sheet between the pair of side rails.

11 Claims, 4 Drawing Sheets

PLAYGROUND SLIDE

FIELD OF THE INVENTION

The present invention is in the field of recreational equipment, specifically playground slides.

DISCUSSION OF RELATED ART

A variety of different slide constructions have been marketed or patented in the prior art. Some slide beds have unitary construction. For example, inventor Londgren in U.S. Pat. No. 3,263,994 patented Aug. 2, 1966, the disclosure of which is incorporated herein by reference, the inventor provides a slide having a pair of side rails with a groove receiving a slide bed. The slide bed is formed as a single large plank of wood. Other unitary construction slides include injection blow molded or roto molded slides such as U.S. Pat. D368759 issued Apr. 9, 1996 to inventor Fuligni.

Some slide beds are section formed and linked together. In Ahrens, U.S. Pat. No. 4,932,648, issued Jun. 12, 1990, the disclosure of which is incorporated herein by reference, a slide is made of sections forming a bed way. The sections are roto molded and interchangeable having tongue and groove connections between the wall and side wall.

One common construction is to have a pair of side rails having a group that receives a slide bed. A variety of different references of the prior art described this traditional design. In M. A. Mccree, patented Apr. 26, 1927 entitled playground slide, the disclosure of which is incorporated herein by reference, a playground slide has a left and right side rail. The left and right side rail have a groove that retains a plurality of wood slats to form a slide surface. The playground slide has a convex section. S. J. Podvinecz in U.S. Pat. No. 2,482,637 issued Sep. 20, 1929 entitled playground slide, the disclosure of which is incorporated herein by reference the left and right side rail have grooves with wood slats to form a slide surface after floor material is laid over the slats. Inventor Samman in U.S. Pat. No. 7,662,045 issued Feb. 16, 2010, the disclosure of which is incorporated herein by reference, the slide assembly also has a pair of side rails with an internal groove to receive a slide bed.

SUMMARY OF THE INVENTION

A playground slide has a pair of side rails, including a left side rail and a right side rail, and the pair of side rails is parallel to each other. A slide sheet has a slide sheet top surface, and the slide sheet top surface has a slide sheet left edge. The slide sheet top surface has a slide sheet right edge, and the slight sheet left edge is mounted to a bottom surface of the left side rail. The slide sheet right edge is mounted to a bottom surface of the right side rail. A pair of support rails, namely a left support rail and a right support rail, supports the slight sheet. The pair of support rails is parallel to each other, and the pair of support rails is mounted to a bottom surface of the slide sheet between the pair of side rails. An upper cross brace connects the pair of side rails to the pair of support rails and connects the slide sheet to the pair of side rails and the pair of support rails.

A lower cross brace connects the pair of side rails to the pair of support rails and connects the slide sheet to the pair of side rails and the pair of support rails. A left alignment ridge is formed on the bottom surface of the left side rail, and a right alignment ridge is formed on the bottom surface of the right side rail. Optionally, the left alignment ridge and right alignment ridge both extend downward below a thickness of the slide sheet. In this case, the slide sheet left edge and the slide sheet right edge abuts a side of the alignment ridge. Optionally, the left alignment ridge and the right alignment ridge both extend downward less than half the thickness of the slide sheet. In this case, the slide sheet has a pair of alignment channels for receiving the alignment ridge.

Preferably, the first side rail and the second side rail are made from the same plastic mold, so that the first side rail has a first side rail corner notch, and the second side rail has a second side rail corner notch. The playground slide may also have a ladder having rungs mounted to the slide. The playground slide preferably includes intermediate cross braces connecting between the left side rail and the right side rail.

Figure 1:
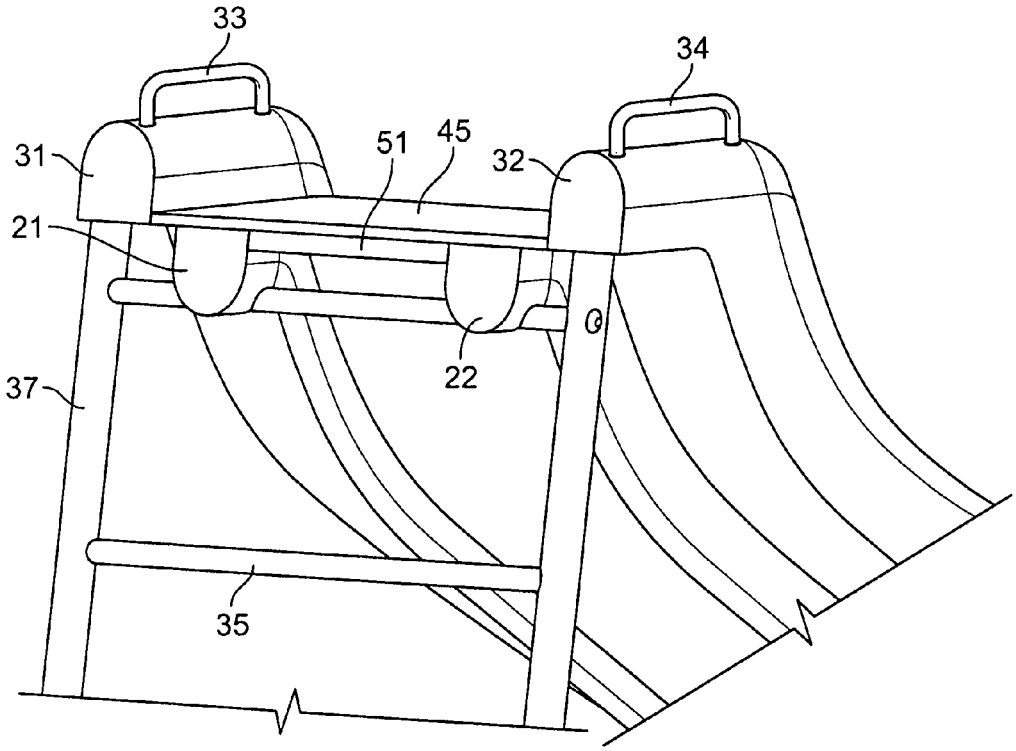
FIG. 1 is a diagram of the top portion of the slide from a rear perspective view.
Figure 2:
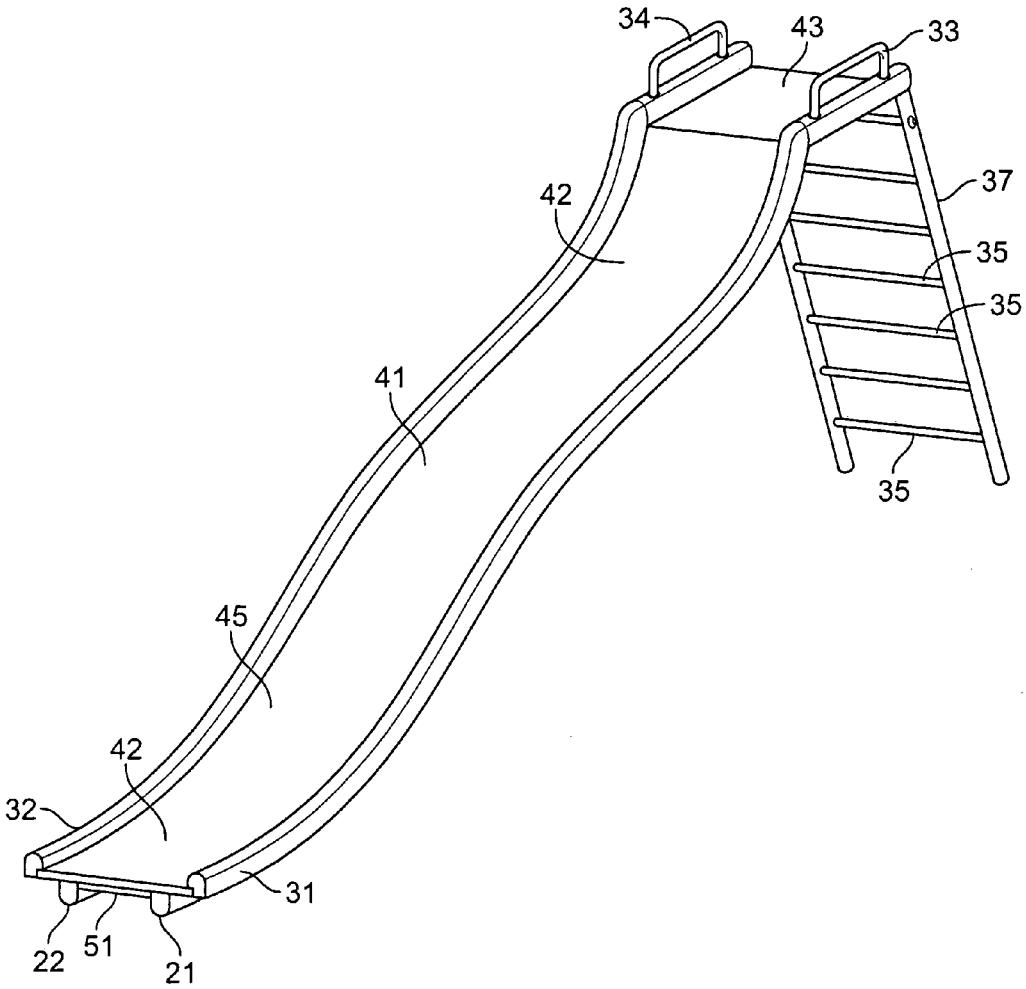
FIG. 2 is a diagram of the front of the slide from a front perspective view.
Figure 3:
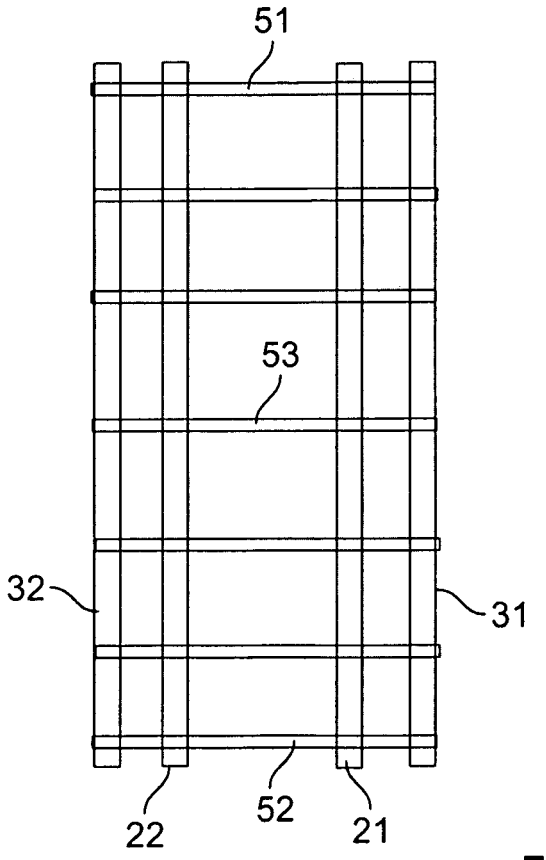
FIG. 3 is a diagram of the support rail and cross brace frame.

The following call out list of elements is a useful guide in referencing the element numbers of the drawings.

21 First Support Rail
22 Second Support Rail
31 First Side Rail
32 Second Side Rail
33 First Hand Rail
34 Second Hand Rail
35 Ladder Rung
37 Ladder Support
41 Convex Area
42 Concave Area
43 Platform Area
45 Slide Sheet
46 Alignment Ridge
47 Corner Notch
51 Top Cross Brace
52 Bottom Cross Brace
53 Intermediate Cross Brace

DETAILED DESCRIPTION OF THE PREFERRED EMBODIMENTS

A playground slide can be put in a backyard and has a support rail and cross brace frame supporting a slide sheet 45. The slide generally includes a pair of side rails. The first side rail 31 and the second side rail 32 form the left and right boundary of the slide surface. The side rails may be formed of a variety of materials, such as wood, metal or a partially hollow plastic injection molding. The slide rails optionally have a corner notch for receiving a corner of a slide sheet 45. The first side rail 31 and the second side rail 32 connects to a left edge and a right edge of a slide sheet 45. The slide sheet 45 may have a convex area 41 and a concave area 42. The concave area 42 is bent downward and the convex area 41 is bent upward. The downward the end of the concave area 42 of the slide sheet 45 is formed on the slide sheet 45.

The side sheet 45 is retained between the first side rail 31 and the second side rail 32. The slide sheet can be made of sheet metal, but is preferably made of a plastic material such as a polyethylene sheet. The slide sheet 45 also has a platform area that has a generally horizontal surface. The first side rail 31 and the second side rail 32 have a profile to define the shape of the slide sheet 45. The slide sheet 45 can be attached to the corner notch of the first side rail and the second side rail. The corner notch of the first side rail and the corner notch of second side rail extend the length of the slide sheet 45.

The first side rail 31 and the second side rail 32 can be made from the same plastic mold. In this case, the side rail member would have a pair of corner notches 47. A left corner notch would be used when the rail is a right side rail and a right corner notch would be used when the rail is a left side rail. Alternatively, the side rail member can be formed without any notch, but with only a alignment ridge extending along the lower surface of the side rail member. The alignment ridge is preferably parallel to the length of the side rail member so that a user pushes the slide sheet against the alignment ridge and then puts the screws into the slide sheet 45 to secure the slide sheet onto the side rail member. The alignment ridge 46 could also be formed as a discontinuous alignment ridge having gaps.

Figure 4:
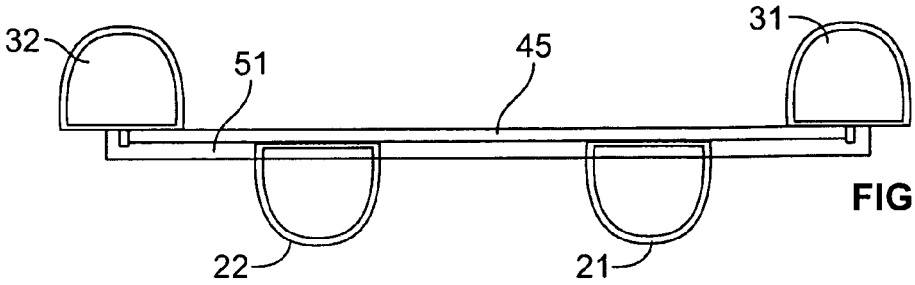
FIG. 4 is a cross section diagram of the slide according to a first embodiment.
Figure 5:
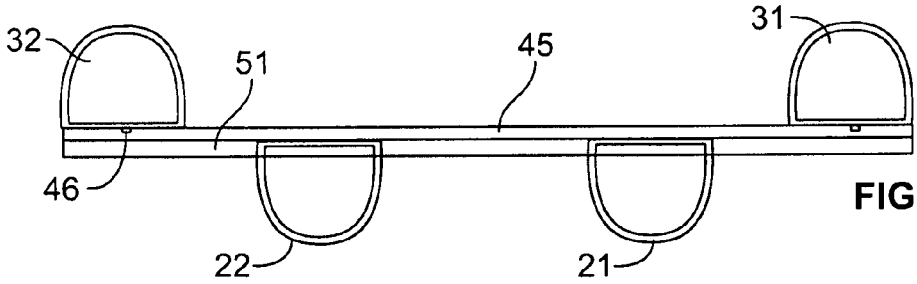
FIG. 5 is a cross section diagram of the slide according to a second embodiment.
Figure 6:
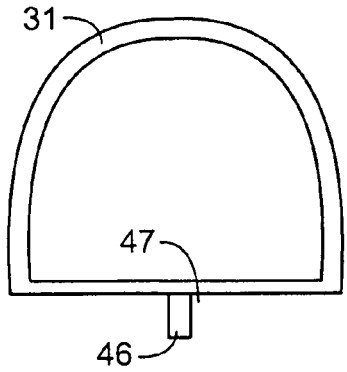
FIG. 6 is a cross section diagram of a side rail.

As seen in FIG. 4 of the present specification, the alignment ridge can be extended below a thickness of the slide sheet 45. Alternatively, the alignment ridge can be very slight and extended into a groove or shallow channel formed on the slide sheet 45. The term 'shallow' means that the channel is less than half the thickness of the slide sheet 45. The shallow channel provides twisting force resistance, while aligning the edge of the slide sheet 45 to the slide rail.

The first side rail and the second side rail are connected at a top cross brace 51. The top cross brace 51 preferably also connects to a left ladder support 37 and a right ladder support 37. The ladder rung 35 connects between the left ladder support and the right ladder support. The top cross brace 51 has connection at the top of the side rails and the bottom cross brace 52 has connection at the bottom of the side rails.

The top cross brace 51 extends between the first support rail 21 and the second support rail 22. The first support rail 21 and the second support rail 22 have a similar top profile as the bottom profile of the first side rail and the second side rail. The first support rail 21 and the second support rail 22 are horizontally offset from the side rails so that there is preferably a gap between the first support rail and second support rail as well as a gap between the support rails and the side rails.

The first support rail and the second support rail are underneath the slide sheet 45 between the side rails. The side rails have a distance between them that is preferably constant and sized to accommodate the width of a person. The support rails are preferably placed underneath the area where the person will be sliding. When measuring the distance between the four rails and determining sizing, it is preferred that the right support rail generally correspond to the path of the right buttock and the left support rail generally correspond to the path of the left buttock. The top cross brace 51 maintains the horizontal distances by connecting the first side rail and the second side rail as well as the first support rail and the second support rail. Similarly, the bottom cross brace maintains the horizontal distances by connecting the first side rail and the second side rail as well as the first support rail and the second support rail.

Optionally, a plurality of intermediate cross braces can be introduced for connecting between the four rails in a ladder like structure beneath the slide. Preferably, a pair of handrails such as a first hand rail 33 and a second hand rail 34 can be installed on the side rails. The handrails can extend through the side rails and connect to the top support rail underneath such as by nuts and bolts or screws.

It is assumed that persons of ordinary skill in the art understand basic connectors such as nuts and bolts or screws, or glue or slotted snap together connections and accordingly, the specification does not go into great detail about these connections. It is generally preferred to use screws to connect the slide sheet to the underside of the side rails. It is also generally preferred to connect the cross brace members such as the intermediate cross braces the top cross brace and the bottom cross brace. Optionally, the cross brace can be further aligned and secured by being received in an opening formed on a side rail or formed on a supporting rail.

When forming by plastic injection molding or roto molding, it is preferred to add UV protection to the plastic. In plastic injection molding, the side rails and the supporting rails are preferably hollow with a hollow cavity. It is preferred to have drain openings formed on the four rail members so as to allow water drainage from the hollow cavities.

The invention claimed is:

1. A playground slide comprising:

a. a pair of side rails, namely a left side rail and a right side rail, wherein the pair of side rails is parallel to each other;

b. a slide sheet having a slide sheet top surface, wherein the slide sheet top surface has a slide sheet left edge and wherein the slide sheet top surface has a slide sheet right edge, wherein the slide sheet left edge is mounted to a bottom surface of the left side rail and wherein the slide sheet right edge is mounted to a bottom surface of the right side rail;

c. a pair of support rails, namely a left support rail and a right support rail, wherein the pair of support rails is parallel to each other, wherein the pair of support rails is mounted to a bottom surface of the slide sheet between the pair of side rails;

d. an upper cross brace connecting the pair of side rails to the pair of support rails and connecting the slide sheet to the pair of side rails and the pair of support rails;

e. a lower cross brace connecting the pair of side rails to the pair of support rails and connecting the slide sheet to the pair of side rails and the pair of support rails and;

f. a left alignment ridge formed on the bottom surface of the left side rail; and a right alignment ridge formed on the bottom surface of the right side rail.

2. The playground slide of claim 1, wherein the left alignment ridge and right alignment ridge both extend downward below a thickness of the slide sheet, wherein the slide sheet left edge and the slide sheet right edge abuts a side of the alignment ridge.

3. The playground slide of claim 1, wherein the left alignment ridge and the right alignment ridge both extend downward less than half the thickness of the slide sheet, wherein the slide sheet has a pair of alignment channels for receiving the alignment ridge.

4. The playground slide of claim 1, wherein the first side rail and the second side rail are made from the same plastic mold, wherein the first side rail has a first side rail corner notch, wherein the second side rail has a second side rail corner notch.

5. The playground slide of claim 1, further comprising: a ladder having rungs mounted to the slide.

6. The playground slide of claim 1, further comprising: intermediate cross braces connecting between the left side rail and the right side rail.

7. The playground slide of claim 6, further comprising: a left alignment ridge formed on the bottom surface of the left side rail; and a right alignment ridge formed on the bottom surface of the right side rail.

8. The playground slide of claim 7, wherein the left alignment ridge and right alignment ridge both extend downward below a thickness of the slide sheet, wherein the slide sheet left edge and the slide sheet right edge abuts a side of the alignment ridge.

9. The playground slide of claim 7, wherein the left alignment ridge and the right alignment ridge both extend downward less than half the thickness of the slide sheet, wherein the slide sheet has a pair of alignment channels for receiving the alignment ridge.

10. The playground slide of claim 7, wherein the first side rail and the second side rail are made from the same plastic mold, wherein the first side rail has a first side rail corner notch, wherein the second side rail has a second side rail corner notch.

11. The playground slide of claim 6, further comprising: a ladder having rungs mounted to the slide.

* * * * *